73-151.5 SR
6/7/83 XR 4,387,295

United States Patent [19] [11] 4,387,295
Minichiello [45] Jun. 7, 1983

[54] PNEUMATIC PENETRATION SENSOR FOR OIL DRILLING

[75] Inventor: George M. Minichiello, Fountain Valley, Calif.

[73] Assignee: Cooper Industries, Houston, Tex.

[21] Appl. No.: 340,824

[22] Filed: Jan. 19, 1982

[51] Int. Cl.[3] ..... G06D 7/00
[52] U.S. Cl. ..... 235/201 R; 235/132 R; 173/21; 73/151.5; 33/132 R
[58] Field of Search ..... 235/200 R-201 PF, 235/92 R, 132 R; 173/21; 73/506, 521, 151.5; 346/33 R, 49; 33/126, 126.5, 126.6, 127-129, 132 R

[56] References Cited

U.S. PATENT DOCUMENTS

| | | | |
|---|---|---|---|
| 3,214,762 | 10/1965 | Winkle et al. | 346/33 R |
| 3,598,310 | 8/1971 | Bingham | 235/201 PF |
| 3,710,084 | 1/1973 | Slagley et al. | 235/92 R |
| 3,750,480 | 8/1973 | Dower | 73/506 |
| 4,024,645 | 5/1977 | Giles | 33/129 |
| 4,156,467 | 5/1979 | Patton et al. | 173/21 |

*Primary Examiner*—Benjamin R. Fuller
*Attorney, Agent, or Firm*—Spensley, Horn, Jubas & Lubitz

[57] ABSTRACT

A device for accurately measuring the position of a traveling block in a drilling rig or the like which is supported by means of a cable wrapped around a drum winch assembly. A pneumatic sensor coupled to the drum provides a predetermined number of output pulses per revolution of the drum. During the paying out of a first layer of cable from the drum, the sensor pulses are coupled to a first pneumatic counter, which is preset so as to provide an output pulse corresponding to a predetermined increment of motion during the paying out of the first layer. Additional counters are provided with different preset limits so that they will provide output pulses corresponding to the predetermined increment of motion during the paying out of second and additional layers of cable from the drum. As the cable is paid out or wound in, the output of the drum motion sensor is coupled to the appropriate pneumatic counter by means of a switching assembly. The switching assembly includes additional pneumatic counters for counting the number of pulses provided by the drum motion sensor during the paying out of an entire layer of cable from the drum and switching valves which are controlled by the additional counters. The arrangement enables accurate measurements to be made based upon drum revolution, despite the fact that the amount of traveling block motion will be different during the paying out of different layers of cable, due to the different diameters of the layers.

6 Claims, 3 Drawing Figures

PNEUMATIC PENETRATION SENSOR FOR OIL DRILLING

BACKGROUND OF THE INVENTION

1. Field of the Invention

This invention relates to the field of oil well drilling, in which a drilling rig is supported by a traveling block. The traveling block is carried by a cable which is looped around a crown pulley and attached to a rotating drum assembly. Specifically, the invention relates to a system for accurately determining the position of the traveling block. This data can be used to determine penetration of the oil well drill bit, the rate of penetration, the hole depth, and speed of the traveling block.

2. Description of the Prior Art

The most common method of obtaining desired positional measurements in a drilling rig is to utilize a measuring line which directly measures distance. These devices have problems with respect to reliability as well as difficulty of repair. As an alternative to direct measurement by means of a wire line, traveling block position may be obtained by determining the amount of cable paid out or wound onto the rotating drum from an arbitrary reference point. This amount of cable is mathematically related to the position of the traveling block in the oil derrick above the rig floor. This relation is a function of the number of feet of cable paid out (or wound in) per drum revolution and the number of lines strung between the crown block and traveling block. A system employing measurement of drum rotation to determine traveling block position is shown in U.S. Pat. No. 4,156,467 to Patton et al.

Because different layers of cable wound around the drum have different diameters, the amount of cable paid out during each revolution of the drum will not be constant. In order to increase the accuracy of the block position determination, some compensation must be made for varying diameters of wraps about the drum. The Patton patent uses a computer to accomplish this function. Other measurement devices which utilize electronics to compensate for varying diameters of material wound about a drum are shown in U.S. Pat. Nos. 3,710,084 to Slagley et al and 4,024,645 to Giles. Although such systems may provide accurate measurements, the use of an electronic measurement system is not desirable in an oil rig environment, because of the possibility of stray electrical signals affecting the operation of the system.

The use of pneumatic devices to measure movement of the traveling block is shown in U.S. Pat. Nos. 3,750,480 to Dower and 3,214,762 to Van Winkle. The use of pneumatic devices avoids problems of interference associated with electronic measurement systems. However, the Dower and Van Winkle systems do not incorporate any type of compensation scheme to ensure that accurate measurements are provided despite the varying diameters of cable wraps around the drum.

SUMMARY OF THE INVENTION

The present invention is directed to a pneumatic measurement apparatus which includes means to compensate for the different amount of cable paid out from the drum which correspond to different layers of wound cable. Pneumatic motion sensors provide output pulses corresponding to a predetermined increment of rotation of the drum. During the paying out of a first layer of cable from the drum from an arbitrary reference point, the output pulses of the motion sensor are fed to a first pneumatic predetermining counter (PDC) which provides an output pulse upon receipt of a preset number of pulses from the sensor. The preset limit of the pneumatic counter is chosen so that the counter will provide one output pulse per predetermined increment of cable paid out (e.g., one pulse per meter). During the paying out of a second layer of cable, the output pulses from the motion sensor are coupled to a second pneumatic counter. The preset limit of the second counter is different from that of the first counter and is chosen so that the second counter will also provide one output pulse per predetermined increment of cable paid out from the drum. Additional pneumatic counters can be supplied so as to count pulses from the motion sensors during the paying out of subsequent layers from the drum.

In order to couple the drum motion sensors to the appropriate pneumatic counter, a switching arrangement incorporating pneumatic switching valves and additional pneumatic counters is employed. A first switching valve is connected between the motion sensors and the first counter and is initially opened so as to pass pneumatic pulses from the motion sensor to the counter. A first additional counter is connected to the motion sensor and counts pulses therefrom. The additional counter is preset so that it will provide an output pulse after the entire first layer of the cable has been paid out. The output of this additional counter is connected to the first switching valve and the output pulse causes the valve to decouple the motion sensor from the first pneumatic counter and couple the motion sensor to the second pneumatic counter through a second switching valve. A second additional counter counts pulses supplied to the second switching valve and closes the connection between the motion sensor and the second pneumatic counter after the paying out of the entire second layer of cable. By employing a plurality of switching valves and one or more additional pneumatic counters, the output of the drum motion sensor can be coupled to the appropriate pneumatic counter during the paying out of each layer from the drum.

BRIEF DESCRIPTION OF THE DRAWINGS

The invention will now be described with reference to the accompanying drawings, wherein.

DESCRIPTION OF THE PREFERRED EMBODIMENT

The following detailed description is of the best presently contemplated mode of carrying out the invention. This description is not to be taken in a limiting sense, but is made merely for the purpose of illustrating the general principles of the invention. The scope of the invention is best defined by the appended claims.

Figure 1:
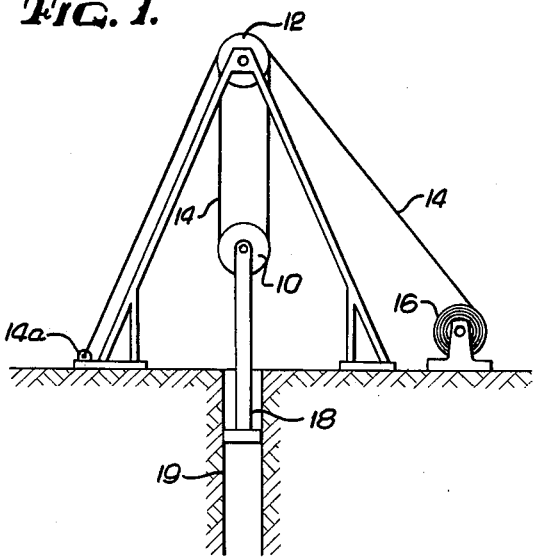
FIG. 1 is a schematic diagram of a traveling block assembly.

Referring to FIG. 1, a traveling block 10 is suspended from a crown block 12 by means of a cable 14. One end of the cable is secured to the ground at a point 14*a*, and the other end of the cable is wrapped around a rotatable drum 16. The drum has a plurality of wraps (one rotation of the cable around the drum) and a plurality of layers (a complete set of wraps that fill the drum from flange to flange in a level, even layer). A drilling apparatus 18 is coupled to the traveling block 10 and extends into a drill hole 19.

Figure 2:
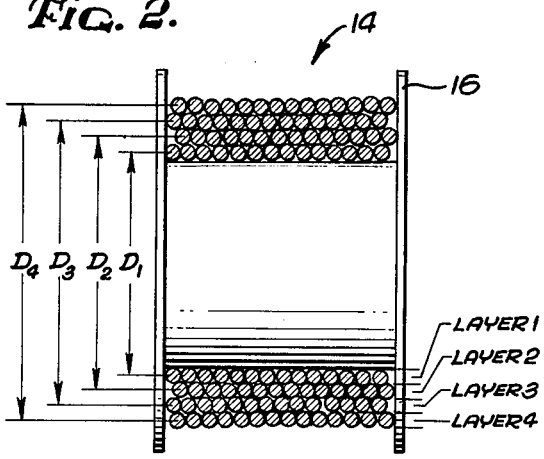
FIG. 2 is a plan view in section showing various layers of cable wound onto a drum.

Referring now to FIG. 2, it can be seen that the diameter of the wraps of different layers on the drum differ. Each of the wraps in layer 1 has a diameter of D1 and each of the wraps in layers 2, 3 and 4 has a diameter of D2, D3 and D4, respectively. Because of these different diameters, the amount of cable 14 paid out or wound onto the drum 16 during one complete revolution will be constant within a layer but will vary between layers. Thus, for example, the amount of wire paid out during one revolution when four layers of cable are on the drum will be equal to D4, whereas the amount of cable paid out during a complete revolution when the cable is down to the first layer will be equal to D1. In order to achieve the most accurate measurement, these varying diameters of the different layers must be taken into account.

Figure 3:
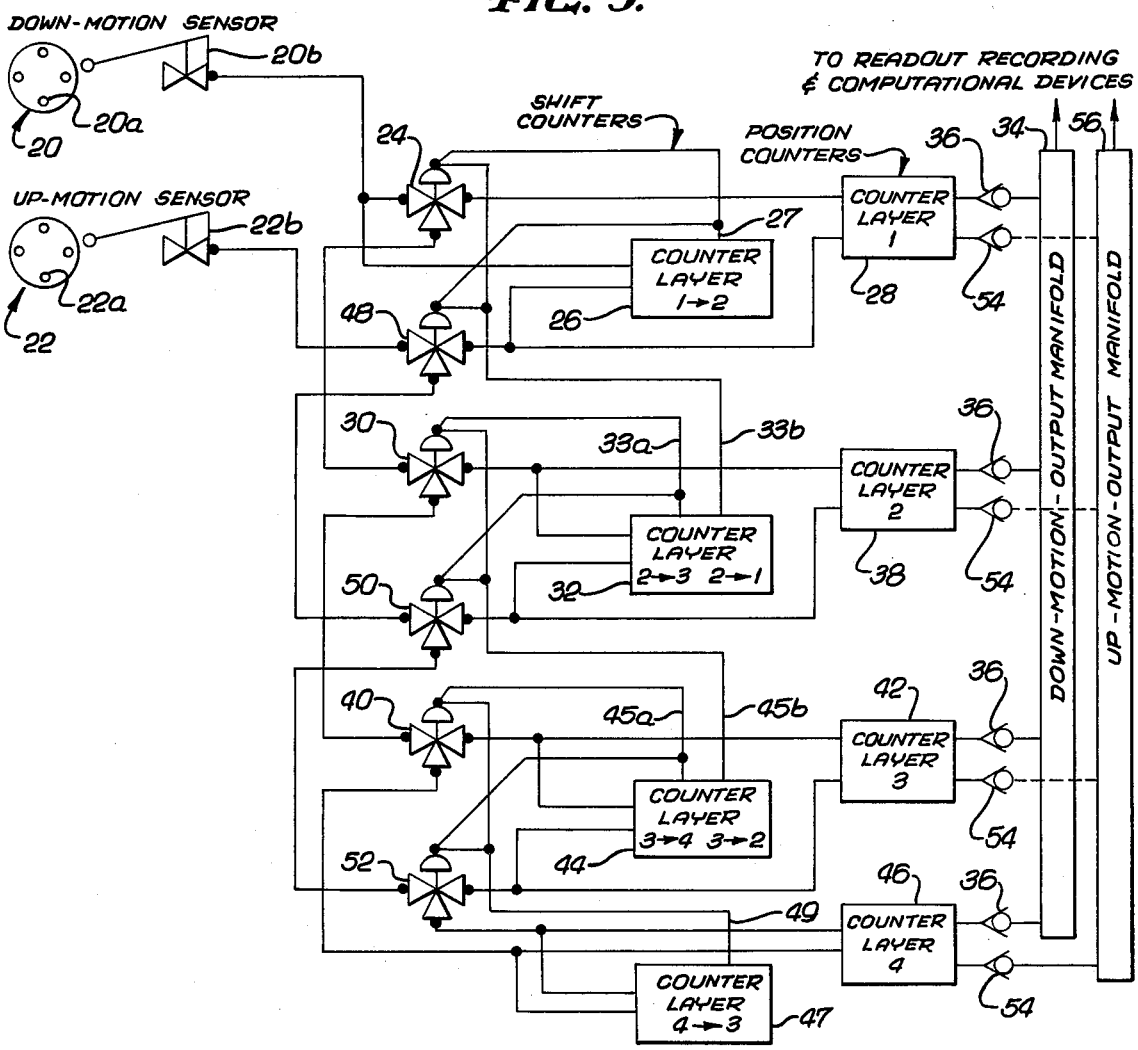
FIG. 3 is a schematic diagram of the traveling block position measurement system of the present invention.

Referring now to FIG. 3, the present invention includes a down motion sensor 20 and an up motion sensor 22 coupled to the drum 16. The sensors 20 and 22 include drum crawler follower wheels 20*a* and 22*a* which are attached to the drum 16 and rotate therewith, and pneumatic limit valves 20*b* and 22*b* which detect the motion of the follower wheels. The sensors 20 and 22 emit a pulse of air at a fixed interval of drum rotation. The sensor output is thus some predetermined number of pulses of air per revolution of the drum. The sensor 20 emits pulses only during down motion of the traveling block, and the sensor 22 emits pulses only during up motion of the traveling block.

The output of the down motion sensor 20 is connected to the input of a pneumatic switching valve 24, one output of which is in turn connected to the inputs of bidirectional pneumatic counters 26 and 28. The counters are conventional devices that accept pulse inputs and count them until the count reaches a value that equals a preset number that has been manually entered into the device. When its preset number is reached, the counter will provide a pulse output. The output of the counter 26 is connected to control inputs of the switching valve 24 and a switching valve 48. A second output of the valve 24 is connected to an input of a switching valve 30. In a similar fashion, the output of the up motion sensor 22 is connected to the valve 48, whose outputs are connected to the counters 26 and 28 and a switching valve 50.

When the drilling apparatus 18 is in its lowest position, the drum 16 will be fully unwrapped. As the drill is raised, the valve 48 couples the output of the up-motion sensor 22 to the counters 26 and 28. The counter 28 is preset so that it will provide an output pulse upon the receipt of a predetermined number of pulses from the sensor 22 which correspond to a fixed amount of travel of the block 10 (e.g., one pulse per meter). The output pulses are sent to an output manifold 34 through a check valve 36.

The counter 26 is preset to a number equal to the number of pulses provided by the sensor 22 per revolution of the drum times the number of wraps in the first layer. Therefore, when the entire first layer has been paid out, the counter 26 will emit an output pulse on line 27. This pulse causes the valves 24 and 48 to switch over and couple the output of the sensors 20 and 22 to the counters 32 and 38 through valves 30 and 50. The counter 28 thus stops counting pulses from the sensor 22. The counter 38 is preset to a different number than the counter 28 in order to compensate for the different diameter of layer 2 of the cable. The preset number of the counter 38 is such that it will emit one pulse per predetermined increment of motion of the traveling block 10 (e.g., one pulse per meter). For example, as layer 1 is being paid out or wound in, one meter of block travel may correspond to ten pulses from the down motion sensor 20 or up motion sensor 22. The limit of the counter 28 would thus be set at ten. During the paying out of layer 2, one meter of motion of the traveling block may correspond to twelve output pulses from the sensor 20 and 22, and the limit of the counter 38 would be set to twelve. Thus, the counters 28 and 38 will each provide one output pulse per meter of movement of the traveling block 10 despite the fact that the layers being paid out or wound in have different diameters.

The pneumatic counter 32 has its preset limit set at the number of sensor pulses produced during the winding of the entire second layer of the cable. Therefore, at the end of the winding in of the second layer, the counter 32 will generate a pneumatic pulse on line 33*a*. This pulse is used to switch the valves 30 and 50 so as to break the connection between the sensors 20, 22 and the counter 38 and to connect the sensors 20 and 22 to valves 40 and 52, respectively. In their initial positions, the valves 40 and 52 are opened to couple the sensor 22 output to a pneumatic counter 42, whose preset limit is set to provide one output pulse per meter of block travel, and to a pneumatic counter 44. After the third layer of cable has been wound in, the counter 44 generates a pulse on line 45*a* which switches the output of the valves 40 and 52 so as to couple pulses from the sensors 20 and 22 to counters 46 and 47. The counter 46 will then count pulses from the sensor 22 during the winding in of the fourth layer of cable, and its preset limit is set so as to provide one output pulse per meter of block travel, as is the case with the counters 28, 38 and 42.

When the direction of drum motion reverses (i.e., when cable is being paid out), the down motion sensor 20 will provide pulses to the various counters. Thus, when a transition from up to down motion occurs while the cable is in layer 4, down pulses will be provided by the sensor 20 to the counters 46 and 47. When layer 3 is reached, the counter 47 provides a pulse on line 49 to switch the valves 40 and 52 back to their original positions. Motion pulses during the paying out of the third layer will thus be coupled to the appropriate counter, i.e., counter 42. In the transition from layer 3 to layer 2, the counter 44 will provide a pulse on line 45*b* to switch valves 30 and 50 back to their original positions. Similarly, when the transition from layer 2 to layer 1 is made the counter 32 will provide a pulse on line 33*b* to switch the valves 24 and 48 to their original positions. Thus, the counters 26, 32, 44 and 47 control the switching of the valves 24, 30, 40, 48, 50 and 52 to insure that the appropriate counter 28, 38, 42 and 46 receives pulses from the motion sensors. In order to accommodate reverse rotation, the counters 32 and 44 provide pulses corresponding to each end of a layer of cable.

The output of each of the counters 28, 38, 42 and 46 is coupled to a manifold 34 through a check valve 36, which prevents air flow from the manifold back into the counters. The output of the manifold can be connected to a number of recording or indicating devices, depending upon the particular application. For reverse rotation the drum check valves 54 and output manifold 56 are provided. Pulses from the output manifolds 34 and 56, representing forward and reverse rotation of the drum, can then be separately added and subtracted when performing desired computations. The counters 26, 28, 32, 38, 44 and 46 are all bidirectional counters which count pulses from the sensor 20 representing down motion of the traveling block (connections shown in solid lines) and pulses from the sensor 22 representing up motion of the traveling block (connections shown in dashed lines).

Broadly, the present invention includes a number of pneumatic predetermining counters which are selectively coupled to the output of a pneumatic sensor. Each of the counters has a different preset limit so that it will provide an output pulse corresponding to a predetermined increment of motion of the traveling block during the paying out or winding in or a particular layer of cable from the drum. A control section including a number of switching valves and additional pneumatic counters is provided to couple the output of the sensors to the appropriate counter during the paying out or winding in or any particular layer of cable. The counters in the control section have predetermined limits which are set so that each one counts the number of wraps in a particular layer of cable wound about the drum.

In summary, the present invention provides increased accuracy in the determination of traveling block position in an oil drilling rig by providing a separate measuring device to measure the travel of the traveling block during the paying out or winding on of each separate layer of cable on a drum. The measuring devices compensate for different diameters of the different layers of cable. The measuring devices comprise pneumatic counters whose limits are adjustable so that they provide an output pulse upon the receipt of a predetermined number of pneumatic input pulses. The input pulses are provided by pneumatic sensors coupled to the drum carrying the cable which supports the traveling block. Each of the counters is preset so that it will provide a fixed number of output pulses per increment of travel of the traveling block during the paying out or winding in of a particular layer of cable. Additional counters (shift counters) are provided to count the number of wraps in each layer of the cable and control a plurality of switching valves so as to couple the output of the drum motion sensors to the appropriate counter. The use of a pneumatic system as described results in high accuracy measurements without the drawbacks associated with electronic measurement systems.

I claim:

1. Apparatus for accurately determining the amount of wire paid out from a drum, comprising:

a pneumatic motion sensor coupled to the drum for providing a predetermined number of pneumatic output pulses for each revolution of the drum;

a first pneumatic counter for counting pulses from the sensor during the paying out of a first layer of wire from the drum and providing a pneumatic output pulse upon receipt of a predetermined number of pulses from the sensor, wherein each output pulse from the first counter corresponds to the paying out of an incremental amount of wire from the drum;

at least one additional pneumatic counter for counting pulses from the sensor during the paying out of second and additional layers of wire from the drum, each of said counters providing a pneumatic output pulse upon receipt of different predetermined numbers of pulses from the sensor, wherein each output pulse from the additional counter(s) corresponds to the paying out of said incremental amount of wire from the drum; and pneumatic switching means for connecting the output of the sensor to the appropriate pneumatic counter as the wire is paid out from the drum.

2. The apparatus of claim 1 wherein:

said motion sensor includes a first sensor for providing pulses corresponding to one direction of drum rotation and a second sensor for providing pulses corresponding to the other direction of drum rotation; and said pneumatic counters are bidirectional counters, whereby the outputs of the counters can be used to determine the position of the wire as it is payed out from or wound onto the drum.

3. The apparatus of claims 1 or 2 wherein the switching means includes:

one or more shift pneumatic counters connected to the motion sensor for providing an output pulse upon receipt of a predetermined number of pulses from the motion sensor corresponding to the number of sensor pulses produced per each lay of wire; and one or more pneumatic switching valves for selectively coupling the output of the motion sensor to the first and additional pneumatic counters, wherein the output of the shift counters controls the switching of the valves.

4. Apparatus for determining the position of a traveling block coupled to a wire line which is wrapped around a drum, comprising:

a first motion sensor for providing a pneumatic output pulse for predetermined increment of rotation of the drum in a first direction;

a second motion sensor for providing a pneumatic output pulse for predetermined increment of rotation of the drum in a second direction;

a first bidirectional pneumatic counter for counting pulses from the motion sensors and providing forward and reverse pneumatic output pulses upon receipt of a predetermined number of pulses from the first and second sensors, respectively;

one or more additional bidirectional pneumatic counters for counting pulses from the motion sensors and providing forward and reverse pneumatic output pulses upon receipt of a predetermined number of pulses from the first and second sensors, respectively; and pneumatic switching means for coupling the output of the sensors to the first counter during the wrapping or unwrapping of a first layer of wire on the drum and coupling the output of the sensors to the additional counters during the wrapping or unwrapping of second and additional layers of wire on the drum, wherein said predetermined number of input pulses per output pulse for each pneumatic counter is chosen so that an output pulse from each counter corresponds to a predetermined increment of motion of the traveling block, whereby the output pulses from the counters can be used to accurately determine the position of the traveling block.

5. The apparatus of claim 4 wherein the switching means comprises:

a plurality of switching valves for selectively connecting the motion sensor outputs to one of the pneumatic counters; and at least one shift bidirectional pneumatic counter having its inputs coupled to the outputs of the motion sensors and its outputs connected to control the operation of the switching valves, wherein each shift counter provides an output pulse after receipt of a predetermined amount of sensor pulses which correspond to the unwrapping of a particular layer of wire, whereby the valves are switched at the end of each layer to connect the sensors to the appropriate one of the first or additional pneumatic counters.

6. Apparatus for accurately determining the amount of cable paid out from a drum, comprising:

a sensor coupled to said drum for providing a predetermined number of pneumatic output pulses for each revolution of the drum;

a first switching valve connected to the output of the sensor;

a first pneumatic counter connected to the switching valve, wherein when the switching valve is in a first position the sensor output will be coupled to the counter, wherein the counter provides a pneumatic output pulse upon receipt of the first predetermined number of input pulses from the sensor;

a second pneumatic counter connected to the switching valve, wherein when the switching valve is in a second position the sensor output will be coupled to the second counter, wherein the second counter provides a pneumatic output pulse upon receipt of a second predetermined number of input pulses from the sensor and wherein an output pulse from either the first and second counters corresponds to the paying out of an incremental amount of wire line from the drum; and a third pneumatic counter connected to the sensor, wherein the third counter provides a pneumatic output pulse upon the receipt of a third predetermined number of input pulses from the sensor, wherein the output of the third counter is coupled to the switching valve to cause the valve to switch from the first position to the second position, wherein the third predetermined number corresponds to the number of sensor pulses outputted during the paying out of a first layer of wire line from the drum.

* * * * *